United States Patent [19]

Buck

[11] Patent Number: 4,688,649

[45] Date of Patent: Aug. 25, 1987

[54] MECHANICAL DRILL STRING JAR

[76] Inventor: David A. Buck, 4225 Hwy. 90 East, Broussard, La. 70518

[21] Appl. No.: 797,400

[22] Filed: Nov. 12, 1985

[51] Int. Cl.[4] ..... E21B 4/06; E21B 4/10

[52] U.S. Cl. ..... 175/299; 175/304; 175/305

[58] Field of Search ..... 175/229, 300, 304–306, 175/298, 299, 293

[56] References Cited

U.S. PATENT DOCUMENTS

| | | | |
|---|---|---|---|
| 2,008,743 | 7/1935 | Black | 175/304 |
| 2,065,135 | 12/1936 | Huddleston et al. | 175/304 X |
| 2,144,869 | 1/1939 | Boulter | 175/300 X |
| 2,819,877 | 1/1958 | Koppl | 175/304 X |
| 2,978,048 | 4/1961 | Walker | 175/304 X |
| 4,376,468 | 3/1983 | Clark | 175/304 |

*Primary Examiner*—Stephen J. Novosad

*Assistant Examiner*—David J. Bagnell

*Attorney, Agent, or Firm*—John D. Jeter

[57] ABSTRACT

A mechanical jar used primarily on drill strings, in earth boreholes, to aid in freeing drill strings stuck in a well bore. A telescoping drill string component is constrained in a selected telescoped condition by a biased lock until enough axial stress is applied to the telescoped jar to release the lock. Energy stored in the stressed length of drill string then moves rapidly to strike a solid limit to the telescoping travel. The inertia of the moving part of the drill string applies a shock to the stationary, downwardly continuing part of the drill string. The shock is to aid in releasing the stuck string situation. The tension required to release the lock is adjustable, as a design alternative, by applying torque to the drill string. The jar can, by design alternative, be used to strike in either or both axial directions.

3 Claims, 7 Drawing Figures

MECHANICAL DRILL STRING JAR

Field of Utilization

Apparatus of this invention is usable on drill strings, in earth boreholes in rotary drilling practice. The specific application is to produce an axial shock load, when needed, by pulling the drill string from the earth surface, with enough force to trigger the shock mechanism to aid in freeing stuck drill strings.

The device is usable in fishing operations, commonly useful in recovering parts of drill strings lost in the hole from previous drilling operations.

BACKGROUND OF THE INVENTION

It is an unfortunate but common occurrence for drill strings to become stuck or lodged in earth boreholes. Sometimes, skillful manipulation of the drill string and drilling fluid flow controls at the earth surface by the driller frees the stuck string without damage. The presence of jars on the drill string to administer axial shock to the stuck portion of the drill string determines the outcome of the efforts. Jars included in the assembly of the drill string must behave as a normal drill string component until, and if, needed.

Fishing jars are used only after a drill string length is left in the well from previous drilling operations. In this case, the fishing jar does not have to withstand the rigors of normal drilling, and certain design liberties can be taken with durability and fluid flow facilities. The fishing jar will often be fitted with a "fishing" device on the lower end to aid in reattaching the fishing string to the lost drill string length. Drilling jars in common use have complicated and costly construction features. Also, there is a continuing problem of radial space within the jar. The result is a flow-through fluid channel too small for normal survey and other gear to be lowered along the drill string bore to the drill head region. One solution is to use hydraulic jars, which have construction features favoring a larger flow-through bore. Problems arise in hot holes with hydraulic jars, and alternatives are needed. The apparatus of this invention addresses those problems.

OBJECTS

It is therefore an object of this invention to provide mechanical drill string jars that do not depend upon hydraulic fluid physical parameters to define shock output.

It is another object of this invention to provide mechanical jars of simple construction, easier to construct, assemble, and maintain.

It is yet another object of this invention to provide construction that permits a larger flow-through bore for normal drilling operations.

It is still another object of this invention to provide jars with jarring actions that are adjustable by actions taken at the earth surface, by manipulation of common surface gear.

These and other objects, advantages, and features of this invention will be apparent to those skilled in the art from a consideration of this specification, including the attached drawings and appended claims.

BRIEF DESCRIPTION OF DRAWINGS

FIG. 5 is a cross-section, somewhat enlarged, taken along line 5—5 of FIG. 1*a.

DETAILED DESCRIPTION OF DRAWINGS

Figure 1A:
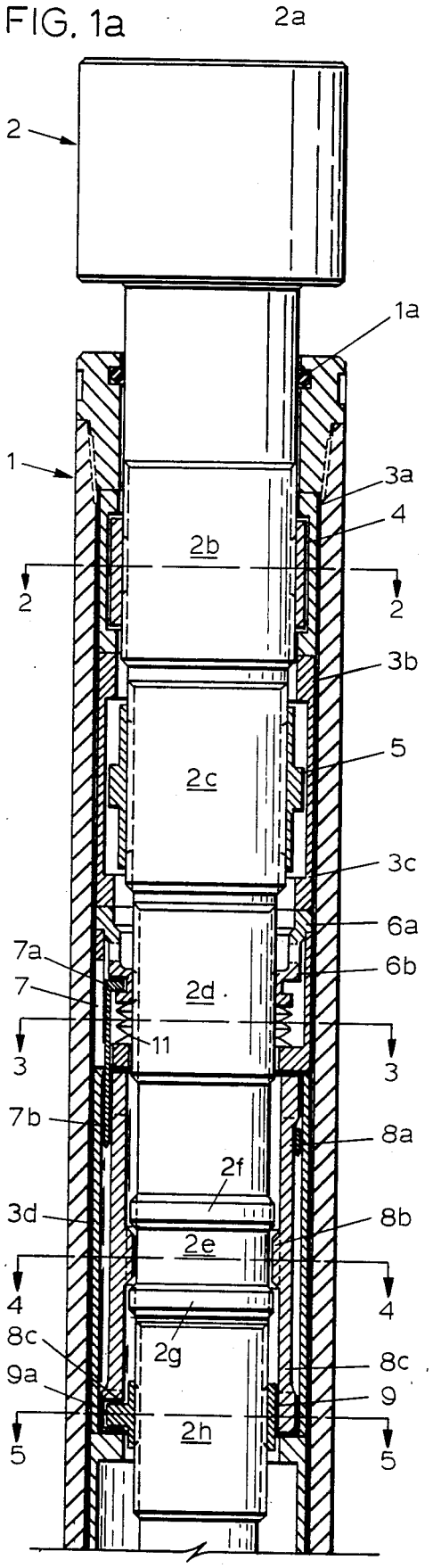
FIGS. 1*a* and 1*b* are continuing plan views, partly sectional, of the preferred embodiment of apparatus of the invention.

In FIG. 1*a*, the upper portion of the preferred embodiment of the invention is shown. A pair of telescoping members, the outer telescoping member 1, and the inner telescoping member 2 are capable of limited axial relative motion and comprise an assembly making up a length of drill string. These two members are secured against uncontrolled relative rotation by lugs inside adapter 3*a* and rotationally interfering lugs on the outside of splined collar 4. Spring 12 (not shown) are situated between the lugs on collar 4 and the lugs on adapter 3*a*, as will be subsequently shown. The springs and the lugs allow some bias restrained relative rotation, in the clockwise direction, as viewed from the top end, but rotation in the opposite direction brings the lugs into solid contact to inhibit relative rotation.

The telescoping relative travel of members 1 and 2 allow a relatively closed condition of the telescoping pair, and that condition is solidly stopped by the enlarged hammer, or striker, ring 5, making contact with the lower abutting plane face, or anvil, of adapter 3*b*. The telescoping pair 1 and 2 can extend to a limited extreme, stopped solidly by contact of hammer 5 with the upper abutting face, or anvil, of adapter 3*b*. This adapter is part of the compression stack of the series 3 elements, which are retained within member 2 by axial compression and keys, as required. The solid stops at the extremes of telescoping travel are capable of imparting shock to outer member 2 in the axial direction.

The normal drilling condition of the telescoping pair 1 and 2 is the intermediate condition shown. By processes yet to be described, the telescoping pair will be held in the intermediate condition until enough axial force is applied to member 1 relative to member 2 to overcome an intermediate condition restraint. When the restraint is overcome, the energy stored in the upwardly continuing drill string will be used against the solid stops at the extreme conditions to transfer the energy to member 2 which will, in turn, transfer the energy to the stuck downwardly continuing drill string, to aid in freeing the stuck string situation.

The intermediate constraint is designed, as will be shown, to use a minimum of radial space to permit a maximum bore size through inner member 2. This bore size is a continuing problem with oil field drilling jars.

The intermediate condition restraint includes two primary elements, latch 8 and cooperating splines 2*f* and 2*g*, on inner member 2. The latch 8 is axially secured in the compression stack member 3*d*, but is free to rotate relative to member 1. A reduced bore diameter in the latch forms spline teeth 8*b*, when the sleeve of latch 8 has radial, axially elongated, slots 8*a* extending through the latch wall. Each tooth 8*b* is associated with a spring bar 8*c*, also produced by the radial slots. The spline teeth will cooperate with the teeth of splines 2*f* and 2*g* to permit conventional spline axial free travel, if cooperatively aligned. If the spline pair is rotationally misaligned, and relative axial motion occurs due to the telescoping sympathetic member 1 and 2, the spline teeth will interfere and give the axial restraint previously defined. The interfering spline teeth contact with conic surfaces. The resulting radial force will strain bars 8*c* radially outward. When enough axial force is applied, member 1 will suddenly be released to move axially relative to member 2. The axial force required for release will depend upon the conic angle and the spring rate of the spring bars. The conic angle can be made different for different directions of axial relative movemement.

To misalign the spline teeth to resist axial movement, alignment collar 9 splined to member 2 by splines 2*h* is used. Lug 9*a* is positioned in opening 8*c* of latch 8, and has a spring (not shown) to urge latch 8 to misalign with teeth of splines 2*f* and 2*g*.

On return from either axial extreme to the intermediate condition shown, the spline teeth of latch 8 and teeth of splines 2*f* and 2*g* are forced to align for free passage by processes yet to be described. Movement from extremes to the intermediate condition is called "cocking" or "resetting."

The latch bars 8*c* have a radial spring rate by design. To alter the spring rate by applying torque to the drill string at the earth surface, the downwardly continuing drill string must resist rotary motion. This is the common situation with stuck strings. As previously stated, and later described in detail, member 2 can be rotated, by force, a few degrees relative to member 1. Such rotation turns movable cam 6*b* relative to stationary cam 6*a*. Saw tooth face cam surfaces move cam 6*b*, which is free to move axially on mating spline 2*d*, downward, overcoming Belleville spring stack 11. Follower 7*a* then moves thrust rods 7 and wedge ring 7*b* downward. Wedge ring 7*b* is in the annular space between spring bars 8*c* and compression stack sleeve 3*d*. This shortens the effective length of spring bar 8*c* and raises the spring rate of the bars. This increases the axial load required to move splines 2*f* or 2*g* through interfering spline 8*b*. As member 2 rotates relative to member 1, lug 9*a* forces the latch 8 to rotate in sympathy and to preserve misalignment. When the displacing torque is relieved, spring 11 restores the wedge ring to the upper position shown.

Figure 1B:
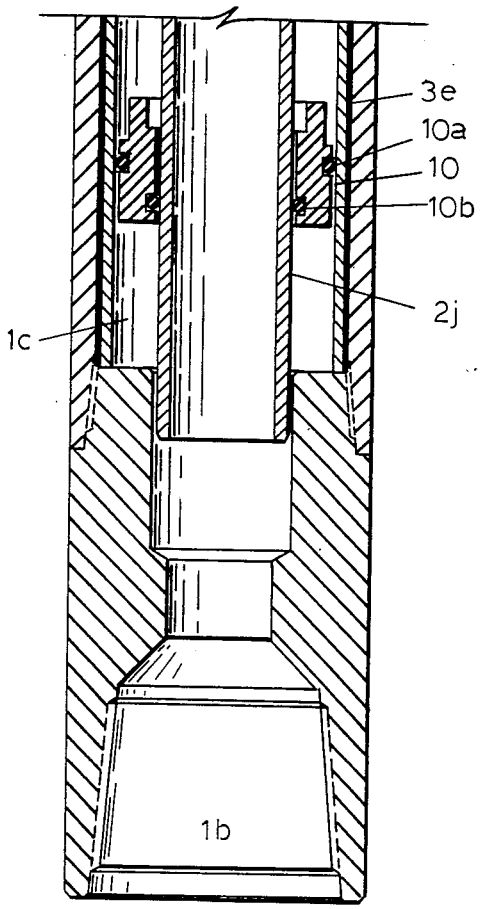

In FIG. 1*b*, the lower end of FIG. 1*a* continues downward. Attachment means 1*b* *is a threaded connector to attach to the downwardly continuing drill string. That may be the usual drill string assembly or a fishing connector to attach, in turn, to a portion of drill string lost in the hole from previous drilling operations. When jarring action takes place, such a connector becomes part of the downwardly continuing drill string.*

Piston 10 is situated for free axial movement in the annular space between the extension 2*g* of member 2 and compression sleeve 3*e*. With seals 10*a* and 10*b*, this represents a seal means to separate oil in the upper, working parts of the tool, and the mud filled annular space 1*c*. The piston can move up and down to compensate for compressibles in the oil filled enclosure and for volumetric changes resulting from telescoping action of the tool.

Figure 2:
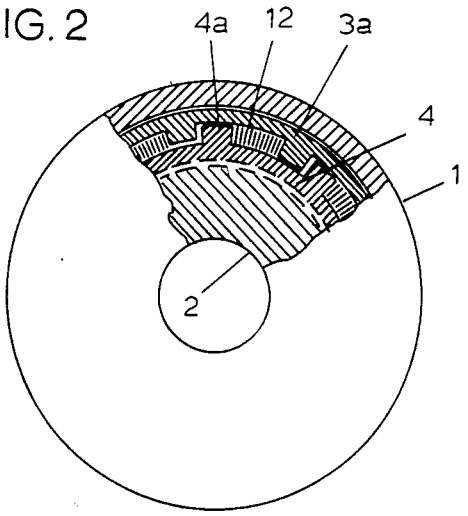
FIG. 2 is a cross-sectional view, somewhat enlarged, taken along line 2—2 of FIG. 1*a;*

FIG. 2, taken along line 2—2 of FIG. 1*a*, shows the bias means to resist and control torque induced rotation of member 2 relative to member 1. Splined collar 4 has lugs 4*a* which rotationally interfere with internal lugs on adapter 3*a*, which is rotationally keyed to member 1 (key not shown). In moving counterclockwise, lugs 4*a* solidly contact the lugs on adapter 3*a* and define the no-torque relationship of members 1 and 2. When member 2 turns clockwise relative to member 1, springs 12 allow resisted relative rotation. These springs are nested linear wave springs, but they are currently being reevaluated. Several spring systems are being considered, but all serve the same function. Member 2 can move axially through splined collar 4.

Figure 3:
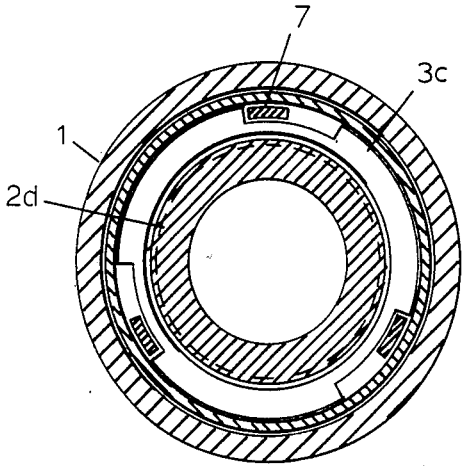
FIG. 3 is a cross-section, somewhat enlarged, taken along line 3—3 of FIG. 1*a;*

FIG. 3, taken along line 3—3 of FIG. 1*a* shows the preferred method for transferring axial movement from cam 6*b* to wedge ring 7*b*. Thrust rod 7 extends through wall openings in compression sleeve 3*c*. The spline 2*d* does not engage elements shown. Room is allowed for the rods 7 to move clockwise as member 2, cam 6, and latch 8 rotate clockwise as torque between members 1 and 2 cause rods 7 to move axially.

Figure 4:
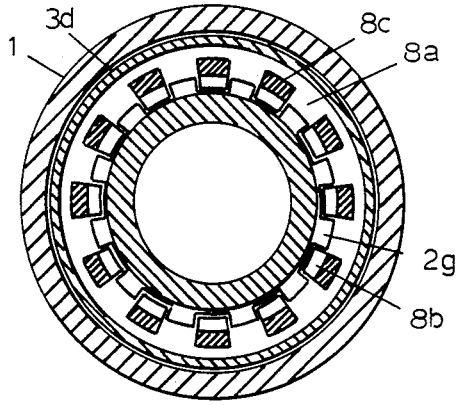
FIG. 4 is a cross-section, somewhat enlarged, taken along line 4—4 of FIG. 1*a;*

FIG. 4, taken along line 4—4 of FIG. 1*a* shows the latch 8 and spline 2*g*. As shown, spline teeth 8*b* and the teeth of spline 2*g* are aligned for free passage as occurs when members 1 and 2 are moving from extreme conditions toward the intermediate, or resetting, condition. As previously described, when the intermediate condition is achieved, the latch 8 will rotate one half spline pitch, and spline 2*g* (or 2*f*) will be in an interfering relationship to spline teeth on latch 8. The action of the interfering relationship has been previously described.

Figure 5:
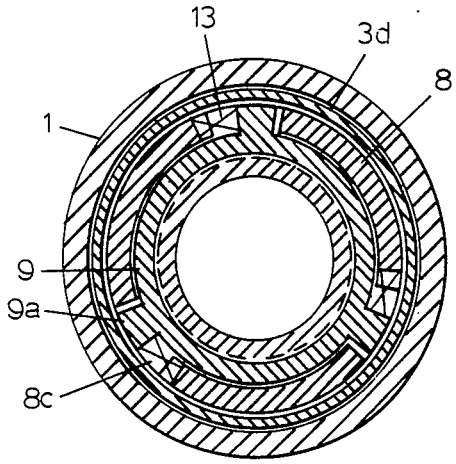

FIG. 5, taken along line 5—5 of FIG. 1*a*, shows the manner of forcing the latch 8 to synchronize with the rotation of member 2 relative to member 1 as torque is applied. Rotational locking is required to keep the latch spline teeth in the interfering relationship, as torque is applied to the drill string to adjust the latch release force. Alignment collar 9 is splined to member 2 by splines 2*h*, and axial relative motion does occur between the two. Lugs 9*a* extend radially into slots 8*c* of latch 8. Clockwise rotation of spline 2*a* brings lugs 9*a* into slid contact with the wall of the slot. This forces clockwise tracking of latch 8. To reset the latch, as will be described later, special spline teeth force latch 8 to override springs 13 and align spline teeth 8*b* and 2*f* or 2*g* for free, non-interfering axial passage.

Figure 6:
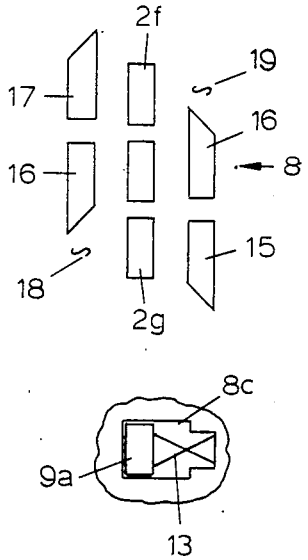
* and FIG. 6 is a development of generally cylindrical features of a selected part of the apparatus of the invention.

FIG. 6 is a development of the splines 2*f*, 2*g*, and 8*b* onto a plane surface. Lug 9 and spring 13 can be regarded as being elevated above the plane of the drawing. Only one set each of the functional spline teeth are shown. The view is toward the centerline of member 2. As developed, the latch 8 can move to the left, corresponding with clockwise as viewed from the top. Member 2 is regarded here as axially movable but rotationally fixed. Latch 8 is axially fixed but free to move only to the extent allowed by lug 9*a* in slot 8*c*. Spring 13 urges the slot, and hence element 8 to the right as limited by lug 9*a*. As shown, the teeth of the splines are in the interfering relationship, appropriate for the axial relationship. As axial travel of member 2 occurs, the latch resistance will function as previously described. When spline 2*g* is above latch 8, and downward motion brings wedge tooth 15 into contact with wedge tooth 16, latch 8 and all associated teeth will be forced to the left, aligning with spline 2*g*, and free downward passage will result. Vacant space 18 will not influence wedge tooth 16. When member 2 moves downward and begins to return upward, the action is the same as just described, but vacant space 19 will not influence wedge tooth 16 on passage. In the position shown, no teeth are in engagement, and the spring has control of the latch to impose the interfering position shown.

From the foregoing, it will be seen that this invention is one well adapted to attain all of the ends and objects hereinabove set forth, together with other advantages which are obvious, and which are inherent to the method and apparatus.

It will be understood that certain features and subcombinations are of utility and may be employed without reference to other features and subcombinations. This is contemplated by and is within the scope of the claims.

As many possible embodiments may be made of the apparatus and method of this invention without departing from the scope thereof, it is to be understood that all matter herein set forth or shown in the accompanying drawings is to be interpreted as illustrative and not in a limiting sense.

The invention having been described, what is claimed is:

1. An improved mechanical drill string jar that allows uninhibited telescoping movement to the normal drilling condition, the drill string jar comprising:

(a) an elongated, generally cylindrical, body usable as a drill string element, comprising; a pair of telescoping members, each with means to attach to a continuing drill string, with at least one annular opening of some length in the coaxial region of said telescoping pair, said telescoping members having at least one axial relationship as a normal drilling condition and at least one axially extreme jarring condition;

(b) axial motion resistance means situated in said annular opening, comprising a splined pair of elements, the splines of which can, if rotationally aligned, move as a splined pair with axial relative motion, each element of said splined pair so engaged with one of said telescoping members that telescoping movement will cause sympathetic axial relative movement of said splined pair, the splines of said splined pair being of such length and location when in the normal drilling condition that said splined pair is rotationally disengaged;

(c) bias means operatively associated with at least one element of said splined pair to rotate said pair out of alignment when said splined pair is rotationally disengaged;

(d) opposed cooperating surfaces on at least two of said spline teeth situated such that forced axial relative motion of said splined pair will produce opposed radial forces on said teeth;

(e) means intrinsic to at least one element of said splined pair to permit resisted radial displacement of said spline teeth when forced axial relative motion occurs, to permit one element to move axially through the other;

(f) cam surfaces on at least one of said teeth situated to force rotational alignment of said splined pair when telescoping movement is from a jarring condition toward said normal drilling condition;

(g) relative rotation resistance means situated in said annular opening, stucturally engaged with said pair of telescoping members such that relative rotation therebetween will be resisted;

(h) striker and anvil means situated in said annular opening, operatively associated with said telescoping pair of elements, such that axial relative movement therebetween will be solidly stopped at said axial extreme condition;

(i) a flow-through fluid channel means extending between said means to attach to the continuing drill string; and (j) seal means situated in said annular opening, operatively associated with said telescoping pair of members, to privide fluid tightness therebetween.

2. The apparatus of claim 1 wherein said axial motion resistance means comprises a splined pair of elements, at least one of which has an elongated tubular structure having a plurality of slots through the wall to form parallel spring bars extending generally parallel the structure centerline, with surfaces extending radially from said bars to form spline teeth, said spring bars to function as said intrinsic means to resist but permit relative axial movement of said splined pair.

3. The apparatus of claim 1 further providing means to adjust the amount of resistance to axial relative motion of said telescoping pair, comprising: means responsive to torque applied to the jar by an upwardly continuing drill string, operatively associated with said axial motion resistance means to adjust said resistance to telescoping movement of said pair from said normal drilling condition an amount proportional to said torque.

* * * * *